US005513846A

United States Patent [19]

Niederlein et al.

[11] Patent Number: 5,513,846

[45] Date of Patent: May 7, 1996

[54] COIN-OPERATED ENTERTAINMENT MACHINE

[75] Inventors: Horst Niederlein, Bingen; Horst Heinen, Stromberg; Konrad Rieck, Gau-Algesheim, all of Germany

[73] Assignee: NSM Aktiengesellschaft, Bingen, Germany

[21] Appl. No.: 334,392

[22] Filed: Nov. 3, 1994

[30] Foreign Application Priority Data

Nov. 5, 1993 [DE] Germany ..... 43 37 727.0

[51] Int. Cl.[6] ..... G09F 23/14

[52] U.S. Cl. ..... 273/143 R

[58] Field of Search ..... 273/143 R, 138 A

[56] References Cited

U.S. PATENT DOCUMENTS 4,250,537 2/1981 Roegner et al. ..... 362/86

5,344,145 9/1994 Chadwick et al. ..... 273/138 A

FOREIGN PATENT DOCUMENTS 3822636 1/1990 Germany .

2083936 3/1982 United Kingdom ..... 273/138 A 2192478 1/1988 United Kingdom ..... 273/138 A

*Primary Examiner*—Benjamin H. Layno

*Attorney, Agent, or Firm*—Spencer, Frank & Schneider

[57] ABSTRACT

A coin operated entertainment machine includes a housing, viewing windows disposed on the housing, and rotating bodies disposed within the housing behind the viewing windows. The rotating bodies have symbols thereon which can be displayed behind the viewing windows. A computer control unit determines a win or loss of a game played on the entertainment machine based on combinations, showing through the viewing windows, of the symbols on the rotating bodies. At least one enticement device is disposed within the housing and includes an enticement element visible from a region outside the housing. The enticement element further comprises individual mirror segments thereon.

17 Claims, 1 Drawing Sheet

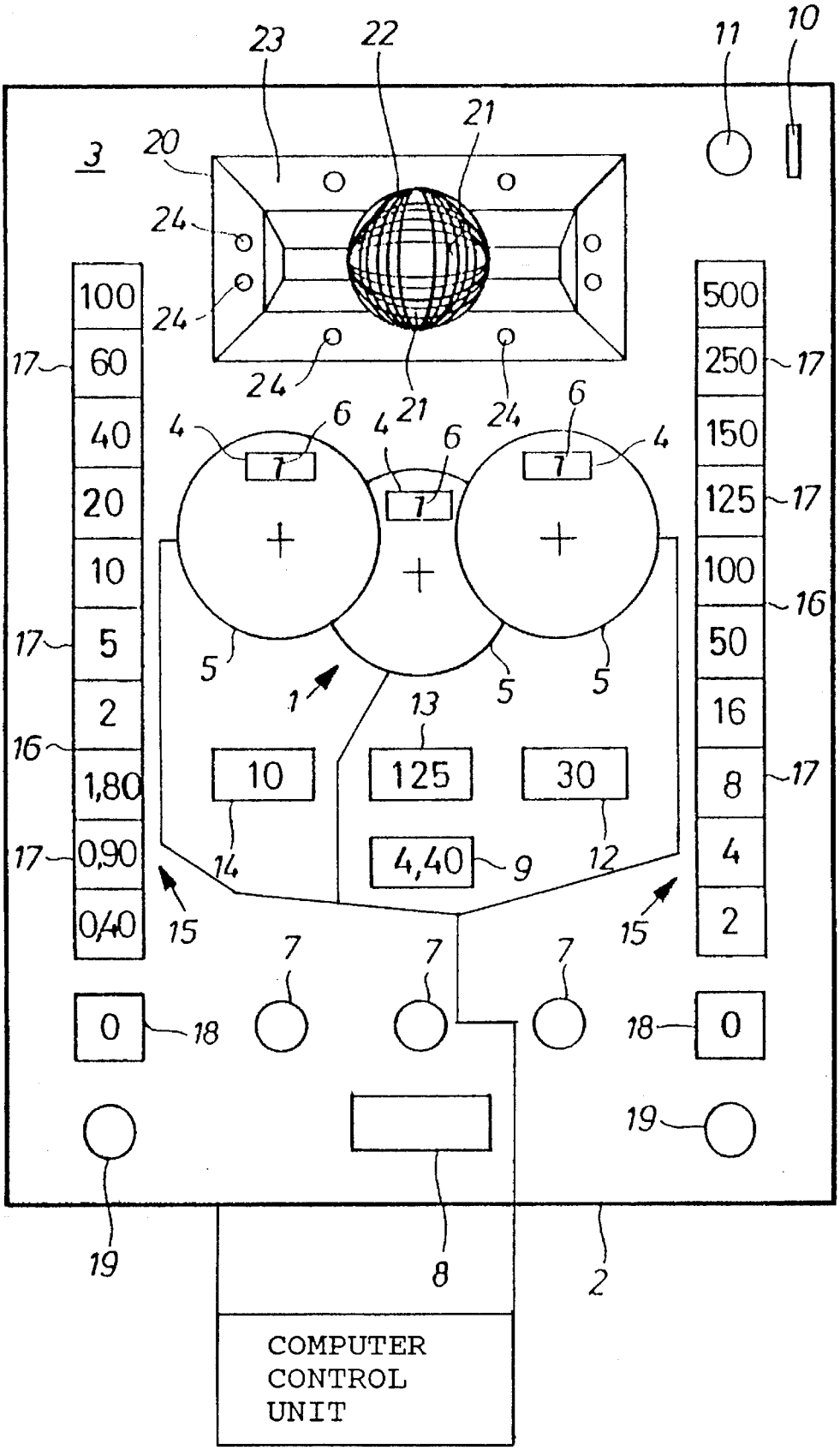
3
20
23
22
21
11
10
24
100
60
40
20
10
5
2
1,80
0,90
0,40
0
500
250
150
125
100
50
16
8
4
2
17
16
4
6
7
1
5
13
10
125
30
4,40
9
14
12
15
18
19
8
2
COMPUTER
CONTROL
UNIT

COIN-OPERATED ENTERTAINMENT MACHINE

BACKGROUND OF THE INVENTION

The invention is related to a coin operated entertainment machine including a housing, viewing windows disposed on the housing, and rotating bodies disposed within the housing behind the viewing windows. The rotating bodies have symbols thereon displayed behind the viewing windows. A computer control unit determines a win or loss of a game played on the entertainment machine based on combinations, showing through the viewing windows, of the symbols on the rotating bodies. At least one enticement device is disposed within the housing and includes an enticement element visible from a region outside the housing.

Entertainment machines in the most various forms are in use. They are embodied as arcade games that is, as games customarily played in an arcade, with or without the possibility of winning money, examples being pinball machines, billiard tables, dart boards, video game machines and like devices. Many different provisions have already been made in order to entice a user or player to use entertainment machines of this kind, and to aid in giving him the proper entertainment value as long as he plays.

German Patent Disclosure DE 38 22 636 A1, for example, discloses an entertainment machine having an entertainment device. This automatic entertainment machine is embodied as arcade jackpot game including a corresponding jackpot device. The slot jackpot device includes, as a rule, three rotating bodies, which can be embodied as rollers or disks or as a folding card carousel. The rotating bodies carry symbols on the externally visible surfaces thereof which are visible through a viewing window of the entertainment machine. A rotation of the rotating bodies is stopped by random control thereof, and, after all the rotating bodies have come to a stop, the symbol combination shown in the viewing windows indicates a win or a loss. At different levels, prizes of money, bonus play, points, and/or free games are promised by the machine. In bonus rounds, a win ratio comes into use the has a higher chance of winning than normal play. In many of these computer-controlled arcade games, actuating mechanisms for the player are installed, which as a rule influence the operation of the individual rotating bodies.

In arcade games of this kind, a further, additional incentive to play, together with an additional prize potential, is offered by a light strip, which, when the machine is not being used, becomes an enticement device. The light strip is made up of different prize information elements. When the machine is not being used, these elements light up one after another in various orders. When a certain prize is earned, a certain element is illuminated, which carries a symbol that refers to the prize earned. If all elements of the light strip are illuminated, the bonus prize is awarded.

Furthermore, known coin-operated arcade games often have a risk game device, which, when a prize has already been earned, can be actuated via a button. At the actuation of the button the prize already earned and the prize that can be earned are visually highlighted on a risk display, which, in between uses, is switched so as to be an enticement device optionally provided with an acoustic background track, which indicates the different prize values. The risk game device randomly decides whether the prize already earned is lost, or increased to the prize that can be earned. When the prize is increased, is then re-displayed as the prize earned, and the prize that is now earnable is once again visually highlighted. The prize earned can be risked once again by means of the risk button. If the random selection means decides that the prize is lost, then the display field associated with the risk display lights up "ZERO" and a new game can begin.

SUMMARY OF THE INVENTION

The object of the invention is to create an entertainment machine of the kind described above, which offers a greater incentive to play.

The above object, and others to become apparent as the specification progresses are accomplished by the present invention, according to which an enticement element, which is visible from the outside and which is composed of individual mirror segments, is inserted into the housing. The enticement element greatly increases the incentive to use the machine by drawing the attention of the people in its vicinity to the entertainment machine. The above is accomplished by configuring the enticement element such that incident light on the mirror segments of the element, whether from daylight, or from room light, is reflected by the mirror segments in a correspondingly large number of directions. Moreover, attention is drawn still more strongly to the machine by the varying light ratios involved and hence by the changing reflective intensity of the mirror segments. In an advantageous embodiment of the invention, in order on the one hand to increase the visibility of the element and on the other hand to intensify the light reflection in comparison to the incident daylight or room light, the element can be illuminated by at least one lamp.

In an advantageous embodiment of the invention, the element is rotatably supported and can be set into rotation by a drive motor. The result is the projection of light whose individual rays of light rotate through the room in which the entertainment machine is installed, which guarantees that the eyes of persons in the room will be strongly attracted to the entertainment machine.

For the purpose of preventing the element from getting dirty and from willful damage, it is disposed behind a window pane in a further embodiment of the invention.

Preferably, the mirror segments of the element are of different sizes. For varying the number of reflected light rays. Advisably, the mirror segments of the element are of different colors. For varying the intensity of reflected light rays.

In a preferred embodiment of the invention, the element is configured as a ball. This configuration makes it possible to embody the element as a relatively small element which can nevertheless accommodate a relatively large number of mirror segments thereon. Alternatively, the element can also be embodied as a cube. In an improvement of the subject of the invention, a reflector is associated with the element in order to increase the light radiation therefrom. Advisably, the reflector is a mirror reflector. In order to further increase the light radiation from the elements and to better increase perception of the element the reflector is configured to be tube-shaped and to include several lamps disposed in its walls and directed toward the element. In this connection, it is preferable to provide a luminosity adjuster for the lamps. Thus a varying light intensity of the reflected light rays is produced.

So that the element can be perceived at approximately eye level by a potential user of the entertainment machine, in a further embodiment of the subject of the invention, the element is disposed with the accompanying reflector centrally above the entertainment device.

In order to produce a particularly intense enticement effect while the entertainment machine is not being used, the element is intermittently or continuously set into rotation and the lamps are turned on.

In a further advantageous embodiment of the invention, when there is a particular game result, for a short time the element is set into rotation and the lamps are turned on. By means of this measure, even people who are not involved in the game have their attention drawn to the occurrence of a particular game event.

Finally, for acoustically reinforcing the visual effect of the element, the element is preferably associated with a speaker, through which the rotary motion of the element is provided with a musical background track.

It is understood that the above-mentioned characteristics, as well as those still to be explained below, can be used not only in the particular combination indicated here, but also in other combinations, or alone, without departing from the scope of the present invention.

BRIEF DESCRIPTION OF THE DRAWING

The fundamental concept of the invention is further explained in the following description of an exemplary embodiment, which is shown in the drawing. The sole figure of the drawing shows a front view of an entertainment machine according to the invention.

DETAILED DESCRIPTION OF THE INVENTION

The housing 2 of the coin-operated entertainment machine, which has a prize potential, contains the entertainment device, which is embodied as a jackpot device 1 that has viewing windows 4 on its front panel 3, behind which three disk-shaped rotating bodies 5 of device 1 are disposed next to one another. A computer control unit 25 having a microcomputer determines the entire gamut of game events, including the determination and payouts of prizes. The control and computer functions are carried out in this connection in accordance with the programs of the microcomputer, which can be adapted to all of the required functions of device 1. After being set in motion at the beginning of play, the rotating bodies 5 are brought to a stop during or at the end of the game in one of a number of possible rest positions by a random selection means associated with the microcomputer. Symbols 6 on the circumference of the rotating bodies 5 are associated with the rest positions, which symbols 6 serve to show the game result in the viewing windows 4. From the symbols 6 shown, the player can view the game result, and particularly also, from a prize list explained on the front panel 3, whether a win has resulted from a combination of symbols 6 shown. In the lower region of the entertainment machine there are several actuating mechanisms 7 with which either the symbols 6 shown in the slot machine-like device 1 can be kept, or a game can be restarted. In the event of a win, a prize disbursment can take place in cash, i.e. by means of coins gushing into a payout tray 8, or by being added up in a coin display 9; the credit can be retrieved into the payout tray 8 by actuating a return button 11, which is disposed next to a coin insert slot 10 of a coin unit (not shown). The coin unit which serves the consumption of coins includes a coin tester, coin storage tubes, and a payout device as well. A positive game result can also consist in that instead of or in addition to a definite monetary prize, a bonus play amount is granted in which a win ratio with a higher chance of winning comes into use. The amount of bonus play is indicated in a bonus play display 12. Furthermore, a positive game result can consist in the receipt of a certain amount of points. Finally, a prize can also be the granting of free games, whose amount is indicated in a free game display 14.

Furthermore, the entertainment machine has two risk game devices 15, each of which includes a prize display 16 made up of several lightable display elements 17 for the individual prizes and in which prizes based on certain symbol combinations device 1 are determined by being played out. The display elements 17 of the left prize display 16 have cash prizes in the lower region and bonus play prizes in the upper region. Bonus rounds offer the player a higher prize expectation, because a certain symbol in a certain viewing window 5 already leads to a maximum monetary prize. The display elements 17 of the right prize display 16 have free game prizes in the lower region and points prizes in the upper region. The prize indicated in the prize displays 17 of either the left or the right prize display can be risked. This happens by means of the fact that the next higher display element 17, with reference to the lighted display element 17 indicating the prize, blinks in alternation with the display field, which has the inscription "0" and which is mounted below the accompanying prize display 17. Upon actuation of a corresponding risk button 19, either the next higher prize is earned, or the player loses. This event can be continued until the highest prize is earned.

In the upper middle of the slot machine-like device 1, an enticement element 22 composed of individual mirror segments 21, which has the form of a ball, is disposed behind a window pane 20 inserted into the front panel 3 of the housing 2. The element 22, which is thus visible from the outside, is rotatably supported on a corresponding mount, and can be set into rotation via a drive motor, which receives its function impulse from the microcomputer. The size of the mirror segments 21 can be identical or varying. Furthermore, the mirror segments 21 can be embodied as having varying colors. A tube-shaped mirror reflector 23, which is embodied to suit the size of the window pane 20, is disposed behind the element 22, in the walls of which reflector 23 several lamps 24 are provided, which are directed toward the element 22. The on/off switching and a dimming of the lamps 24 can be computer controlled or button controlled.

If the entertainment machine is not being used, then the microcomputer on the one hand turns on the drive motor and therefore sets the element 22 into rotation and on the other hand turns on the lamps 24, by means of which the light rays of the lamps 24 are deflected directly via the mirror segments 21 of the element 22 and indirectly via the mirror reflector 23 through the window pane 20 into the room in front of the entertainment machine. Since this directs the attention of the people in the room to the entertainment machine, they will be strongly enticed to play a game. The enticement device comprised of the element 22 and the mirror reflector 23 having the built in lamps 24 can also be turned on for a short time if in the slot machine-like device 1 or in one of the risk game devices 15 a particular game result occurs, for example a maximum prize in either cash, bonus play, points, or free games. It is moreover possible to switch the enticement device on in a timed fashion. Finally, there is also the possibility of only setting the element 22 into rotation or of only turning on the lamps 24. The entertainment machine can moreover also be a coin-operated jukebox.

What is claimed is:

1. A coin operated entertainment machine including:

a housing;

viewing windows disposed on the housing;

rotating bodies disposed within the housing behind the viewing windows, the rotating bodies having symbols thereon adapted to be displayed behind the viewing windows;

a computer control unit connected to the rotating bodies for determining a win or loss of a game played on the entertainment machine based on combinations, showing through the viewing windows, of the symbols on the rotating bodies; and at least one enticement device disposed within the housing and including an enticement element visible from a region outside the housing, the enticement element further comprising individual mirror segments.

2. The coin-operated entertainment machine according to claim 1, wherein the enticement device is at least one of acoustic and visual.

3. The coin-operated entertainment machine according to claim 1, wherein the enticement device further includes at least one lamp for illuminating the enticement element.

4. The coin-operated entertainment machine according to claim 3, wherein the enticement device further includes a tube shaped reflector for increasing a radiation of light from the enticement element, and wherein the at least one lamp includes a plurality of lamps disposed in walls of the reflector such that light generated by the lamps is directed toward the enticement element.

5. The coin-operated entertainment machine according to claim 4, wherein the enticement device further includes a luminosity adjuster for adjusting a luminosity of the lamps.

6. The coin-operated entertainment machine according to claim 4, wherein the enticement device further includes means for setting the entertainment element into rotation, and for turning the lamps on, during times when the machine is not being used.

7. The coin-operated entertainment machine according to claim 4, wherein the enticement device further includes means for setting the entertainment element into rotation, and for turning the lamps on, when a particular game event occurs.

8. The coin-operated entertainment machine according to claim 4, wherein the enticement device further includes a speaker for producing a musical background track to accompany a rotation of the enticement element.

9. The coin-operated entertainment machine according to claim 1, wherein the enticement device further includes:

a support for rotatably supporting the enticement element; and a drive motor for setting the enticement element into rotation.

10. The coin-operating entertainment machine according to claim 1, wherein the enticement device further includes a window pane in front of the enticement element for allowing the enticement element to be visible from a region outside the housing.

11. The coin-operated entertainment machine according to claim 1, wherein the mirror segments are of various sizes.

12. The coin-operated entertainment machine according to claim 1, wherein the mirror segments are of various colors.

13. The coin-operated entertainment machine according to claim 1, wherein the enticement element is a ball.

14. The coin-operated entertainment machine according to claim 1, wherein the enticement element is a cube.

15. The coin-operated entertainment machine according to claim 1, wherein the enticement device further includes a reflector for increasing a radiation of light from the enticement element.

16. The coin-operated entertainment machine according to claim 15, wherein the reflector includes at least one reflector mirror.

17. The coin-operated entertainment machine according to claim 15, wherein the enticement element and the reflector are disposed at an upper middle region of the entertainment machine.

* * * * *